US011378311B2

(12) United States Patent
Kremer et al.

(10) Patent No.: US 11,378,311 B2
(45) Date of Patent: Jul. 5, 2022

(54) HERMETIC COMPRESSOR FOR POSITIVE DISPLACEMENT

(71) Applicant: Whirlpool S.A., Sao Paulo (BR)

(72) Inventors: Rodrigo Kremer, Blumenau (BR); Ricardo Mikio Doi, Joinville (BR); Dietmar Erich Bernhard Lilie, Joinville (BR)

(73) Assignee: WHIRLPOOL S. A., São Paulo (BR)

( * ) Notice: Subject to any disclaimer, the term of this patent is extended or adjusted under 35 U.S.C. 154(b) by 488 days.

(21) Appl. No.: 15/981,968

(22) Filed: May 17, 2018

(65) Prior Publication Data

US 2018/0335233 A1 Nov. 22, 2018

(30) Foreign Application Priority Data

May 19, 2017 (BR) ..... 10 2017 010629 2

(51) Int. Cl.

| | |
|---|---|
| ***F04B 35/04*** | (2006.01) |
| ***F25B 31/02*** | (2006.01) |
| ***F04C 29/06*** | (2006.01) |
| ***F04B 39/02*** | (2006.01) |

(52) U.S. Cl.

CPC ..... *F25B 31/023* (2013.01); *F04B 35/04* (2013.01); *F04B 39/023* (2013.01); *F04C 29/068* (2013.01); *F04B 2201/0806* (2013.01); *F04C 2240/30* (2013.01); *F04C 2270/095* (2013.01); *F04C 2270/125* (2013.01); *F25B 2400/07* (2013.01); *F25B 2500/12* (2013.01); *F25B 2500/13* (2013.01)

(58) Field of Classification Search

CPC .... F25B 31/02; F25B 31/023; F25B 2500/12; F25B 2400/07; F25B 2500/13; F04B 39/023; F04B 35/04; F04B 2201/0806; F04B 39/0027; F04B 39/121; F04C 29/068; F04C 2240/30; F04C 2270/125; F04C 2270/095

See application file for complete search history.

(56) References Cited

U.S. PATENT DOCUMENTS

| | | | | |
|---|---|---|---|---|
| 4,317,468 | A * | 3/1982 | Schwartz | F04B 39/125 137/540 |
| 4,384,635 | A * | 5/1983 | Lowery | F04B 39/121 181/202 |
| 2006/0051232 | A1* | 3/2006 | Ooi | F04B 35/00 418/229 |
| 2008/0138212 | A1* | 6/2008 | Schwarzkopf | F04B 27/1804 417/222.1 |
| 2008/0213115 | A1* | 9/2008 | Hilger | F04B 9/042 417/569 |
| 2014/0318161 | A1* | 10/2014 | Furberg | F25B 41/20 62/115 |
| 2015/0147207 | A1* | 5/2015 | Sobol | F04B 17/003 417/415 |
| 2015/0184651 | A1* | 7/2015 | Ki | F04B 35/045 417/349 |
| 2016/0305431 | A1* | 10/2016 | Lee | F04C 29/068 |

* cited by examiner

*Primary Examiner* — Essama Omgba
*Assistant Examiner* — Dnyanesh G Kasture
(74) *Attorney, Agent, or Firm* — Foley & Lardner LLP

(57) ABSTRACT

The invention in question pertains to the technological field of refrigeration compressors.

A hermetic compressor for positive displacement is disclosed whose airtight housing is specially altered so that its natural frequencies of vibration are distributed at frequencies above 4200 Hz and whose "capacitance density" is greater than 160 W/L.

4 Claims, 3 Drawing Sheets

HERMETIC COMPRESSOR FOR POSITIVE DISPLACEMENT

FIELD OF THE INVENTION

The invention in question is related to a hermetic compressor for positive displacement, and more particularly, a reciprocating hermetic compressor applicable in refrigeration systems in general, whose generated operating noise is predominantly in a low perceived frequency range by human hearing.

FUNDAMENTALS OF THE INVENTION

As known to those skilled in the art, hermetic compressors for positive displacement are essentially integrated by an airtight housing within which are functionally housed, cooperatively, at least one electric motor and at least one compression mechanism, which is basically composed of a cylinder-piston assembly. In this sense, the operation of the electric motor, the movement of the piston inside the cylinder compressing refrigerant vapor and the operation of the compressor valves generate undesirable vibrations and noises (continuous noise).

The current techniques for noise reduction of reciprocating hermetic compressors can be classified (i) in the techniques that act in the reduction of the source of excitation transients; (ii) in the techniques that act in the reduction of transmission paths between the source and the final radiator; and (iii) in the techniques that act on the final radiator (mainly housing).

In particular, in view of the widely known principles of vibroacoustics, it is common to observe that the vibrations generated within the compressor in the vapor compression process are transmitted to the housing and can be amplified according to the natural frequencies of vibration of the airtight housing. The traditional airtight housing of the hermetic compressors for positive displacement applied in residential refrigeration systems (refrigerators, for example) have the first natural frequencies from 3200 Hz, which coincides with the frequency range quite sensitive to noise perceptions of human ears. In this way, the airtight housing of the compressor facilitates the noise radiation in a frequency range particularly well perceived by its users. It should be noted that said natural frequencies of the housing are of the cap and body assembly (without considering the fixing base plate of the compressor in the system).

In this context, it is noted that the current state of the art comprises solutions that aim to solve the problems of generation, amplification and radiation of noise in reciprocating hermetic compressors applicable in refrigeration systems in general.

In accordance with a first aspect, it is known that it is possible to reduce the undesirable noises of a hermetic compressor for positive displacement by reducing the speed of operation of the electric motor which integrates the compressor. This possibility arises from an intuitive principle, after all, it is observed that the greater the refrigeration capacity of a compressor (the higher the speed of operation of its electric motor), the greater is the noise emitted. Thus, considering this first aspect, it is noted that the current reciprocating hermetic compressors applicable in refrigeration systems are generally integrated by an electric motor, whose maximum angular velocity does not exceed 4500 rpm (rotations per minute) to keep the noise within acceptable limits.

In accordance with a second and third aspect, it is known that it is possible to reduce the undesirable noises of a hermetic compressor for positive displacement by altering the specific characteristics of its airtight housing and, in particular, by means of increasing the dynamic structural rigidity of the airtight housing by increasing the thickness of the housing walls and/or optimizing the overall shape of the housing. However, it is worth noting that changing the specific characteristics of the airtight housing of a hermetic compressor for positive displacement may also result in other changes not necessarily beneficial (for example, the increase in the dynamic structural rigidity of the airtight housing by increasing the thickness of the housing walls implies in the increase of the cost of production of the compressor), which must be avoided.

Although the current state of the art does not describe the combination of these two aspects (which are normally studied and applied in an independent manner), it is plausible to assume that, in order to maximally reduce noises particularly unpleasant to users, it is possible to design a reciprocating hermetic compressor applicable to refrigeration systems in general equipped with an electric motor, whose maximum angular speed is less than 4500 rpm and provided with an airtight housing with greater dynamic structural rigidity. This reciprocating hermetic compressor would be extremely quiet, however, would have a severe penalty with respect to its refrigeration capacity and cost of production. This means that said two aspects above discussed are not usually combined due to the unsatisfactory results.

It is based in this context that the invention in question arises.

OBJECTIVES OF THE INVENTION

Thus, it is the fundamental objective of the invention in question to disclose a hermetic compressor for positive displacement whose predominant operating noise generated is situated in a frequency range less perceived by human hearing.

Accordingly, it is an objective of the invention in question that the hermetic compressor for positive displacement disclosed herein be integrated by an airtight housing, particularly provided with natural frequencies situated above 4200 Hz and, at the same time, that the hermetic compressor for positive displacement disclosed herein comprises means capable of generating the traditional refrigeration capacities in domestic refrigeration applications.

SUMMARY OF THE INVENTION

The objectives summarized above are fully achieved by means of the hermetic compressor for positive displacement, which comprises at least one airtight housing (defined by the joining of at least one body and at least one cap), at least one compression mechanism (defined by at least one compression cylinder and a movable piston) and at least one electric motor (controlled by at least one electronic control system), being that the compression mechanism and the electric motor, both housed within said airtight housing, are functionally cooperative with each other.

In accordance with the invention in question, the airtight housing comprises its natural frequencies of vibration above 4200 Hz and the "capacitance density" of the compressor is greater than 160 W/L.

BRIEF DESCRIPTION OF THE DRAWINGS

The invention in question will be particularly detailed in the attached figures, which.

DETAILED DESCRIPTION OF THE INVENTION

With regard to the reciprocating hermetic compressors applicable to refrigeration systems in general, based on the content previously discussed, considering the current state of the art and the teachings covered by it, it is objectively plausible to infer that:

I) The compressor operating noise increases as the compressor motor speed is increased;

II) The compressor operating noise tends to decrease as the dynamic structural rigidity of the compressor housing is increased.

In this sense, the invention in question proposes to reduce the operational noise of the compressor (and also decrease the perception of the operational noise of the compressor) and to maintain the refrigerating capacity thereof, without the penalties of the reduction of operational noise influencing said refrigeration capacity.

Figure 5:
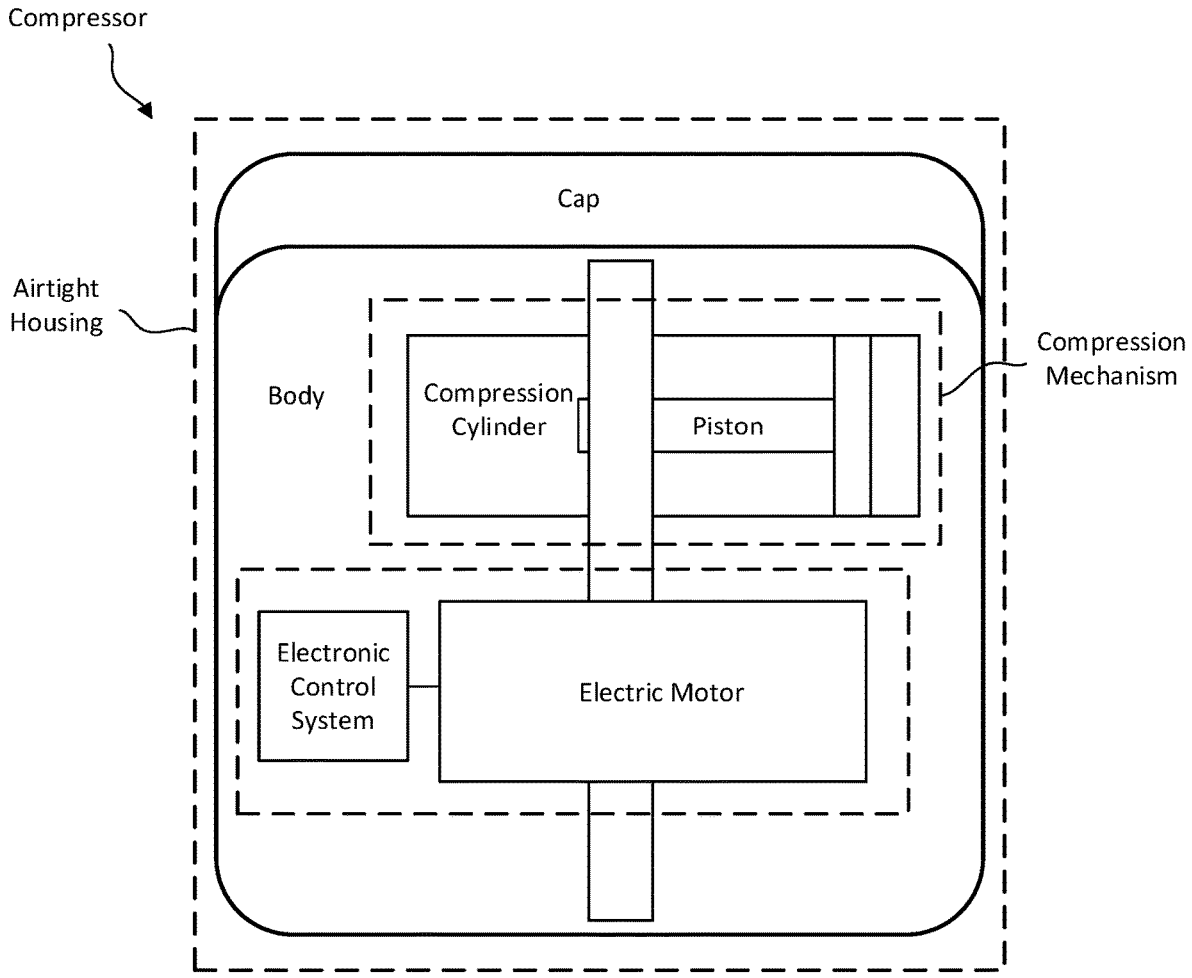
FIG. 5 illustrates a block diagram of a compressor according to an embodiment.

In accordance with an embodiment FIG. 5 depicts a block diagram of a compressor. The hermetic compressor for positive displacement is of the type which minimally comprises an airtight housing, a compression mechanism and an electric motor.

Preferably, but not limited to, the airtight housing is defined by the joining of at least one body and at least one cap, being that these parts, once joined (preferably by means of welding), define a totally hermetic internal volume.

Also preferably, but not limited to, the compression mechanism is defined by at least one compression cylinder and a movable piston capable of being moved, in a reciprocating manner, within said compression cylinder.

Still preferably, but not limited to, an electric motor (integrated by a rotor and a stator) is controlled by an electronic control system which, in general lines, is related to a frequency inverter for controlling electric motors in general.

In addition, it is further highlighted that the compression mechanism and the electric motor are functionally cooperative with each other, and the compression mechanism and the electric motor are housed within said airtight housing.

In general lines, general concepts relating to the preferred embodiment of the components and systems, which integrate the hermetic compressor for positive displacement, according to the invention in question are widely known to those skilled in the art. Consequently, the sufficiency of disclosure of these components and systems is evident in this scenario.

In order to achieve the objectives of the invention in question, it is emphasized that the airtight housing is specially altered so that its natural frequencies of vibration is arranged above 4200 Hz.

As previously discussed, the definition of the natural frequency of vibration of the airtight housing can be carried out in several ways (reduction of the overall size of the airtight housing and changing of the overall shape of the airtight housing, citing only two examples). However, it is particularly suitable that, in accordance with the invention in question, the definition of the natural frequency of vibration of the airtight housing is predominantly given by way of its general miniaturization.

Thus, in accordance with the invention in question, the airtight housing comprises an internal functional volume of less than 1.4 liters. In order to achieve a general miniaturization of the compressor and, consequently, to achieve a housing volume of less than 1.4 liters, it is necessary to make good use of the internal space of the compressor by compaction of the components and optimization of their arrangement inside the compressor. Although the aforementioned actions are done, it is also necessary to reduce the compression cylinder, reducing the refrigeration capacity per compression cycle. In this manner, the compression cylinder of said compression mechanism has a displaced volume of less than 8 $cm^3$.

Figure 2:
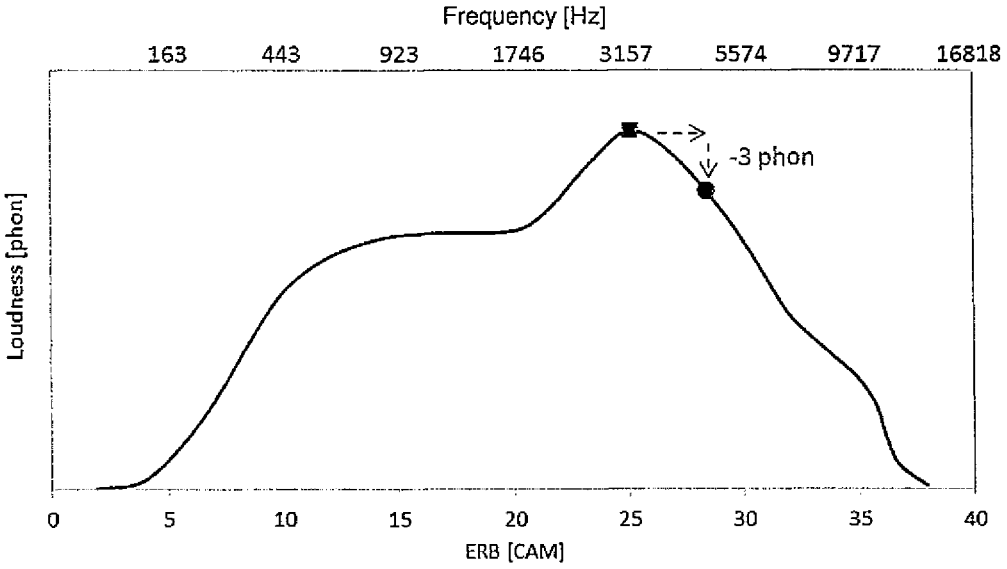
FIG. 2 illustrates a graph of the specific loudness level resulting from a constant sound pressure amplitude. It is noticed the peak of the loudness level in the frequencies around 3100 Hz, for which the human ear has a greater sensitivity to sound pressures. These maximum values are reduced by approximately 3 phon if the frequency is shifted to 4200 Hz.
Figure 3:
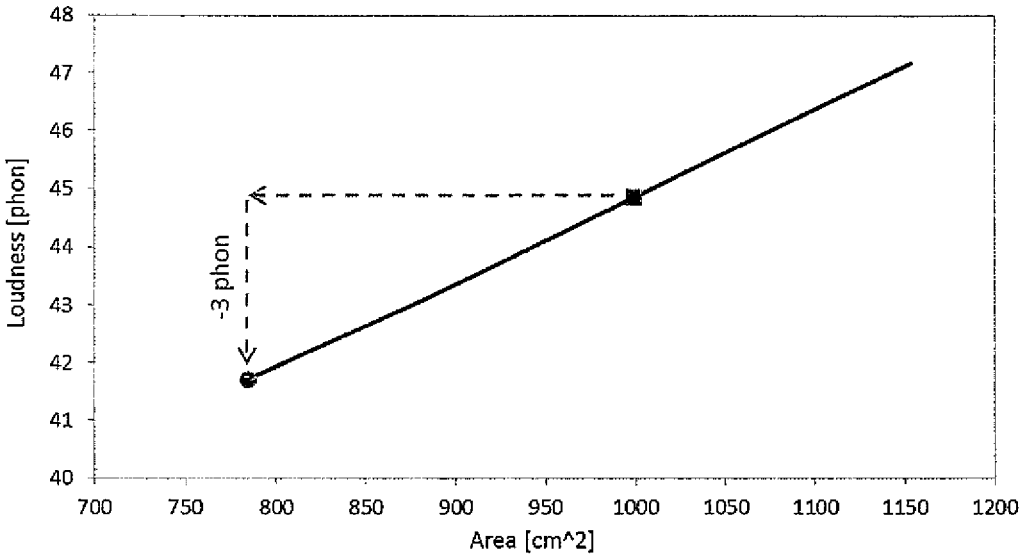
FIG. 3 illustrates a graph of the loudness level as a function of the surface area of the housing. It is noticed a reduction of approximately 3 phon if the housing area is reduced from 1000 $cm^2$ to 800 $cm^2$.

These specifications allow the natural frequencies of vibration of the airtight housing to be "shifted" to a frequency range in which the perception of the human ear decreases by at least 3 phon (in relation to the natural frequencies from 3200 Hz in accordance with the current state of the art), as can be seen in the graph of loudness perception as a function of frequency (FIG. 2). The general miniaturization of the compressor also reduces the surface area of the compressor housing, which reduces the noise radiated by it in at least more 3 phon, in accordance with the loudness perception as a function of the housing area (FIG. 3).

Considering the above specifications—especially that which determines that the natural frequencies of vibration of the airtight housing are set above 4200 Hz, it is noted that a great part of the general objectives of the invention in question are reached, after all, it is known that the human ear has greater perception in the frequencies between 3000 Hz and 4000 Hz and for ranges of frequencies above 4000 Hz the perception begins to diminish.

The penalties—reduction of the refrigeration capacity due to the reduced volumes of the airtight housing and the compression cylinder of the compression mechanism—intrinsic to the displacement of the natural frequencies of vibration of the airtight housing are circumvented by means of adjusting the angular velocity of the electric motor, which is adapted to develop a maximum operating speed of greater than 5000 rpm.

This means that the refrigerating capacity of the hermetic compressor for positive displacement, object of the invention in question, herein penalized in accordance with the dimensional characteristics of the airtight housing and of the compression cylinder, is re-established within the domestic refrigeration standards (between 50 W and 300 W). This refrigeration capacity in an acceptable range is given by the ratio between the operating speed of the electric motor and the compression volume of the compression cylinder of the compression mechanism.

Figure 4:
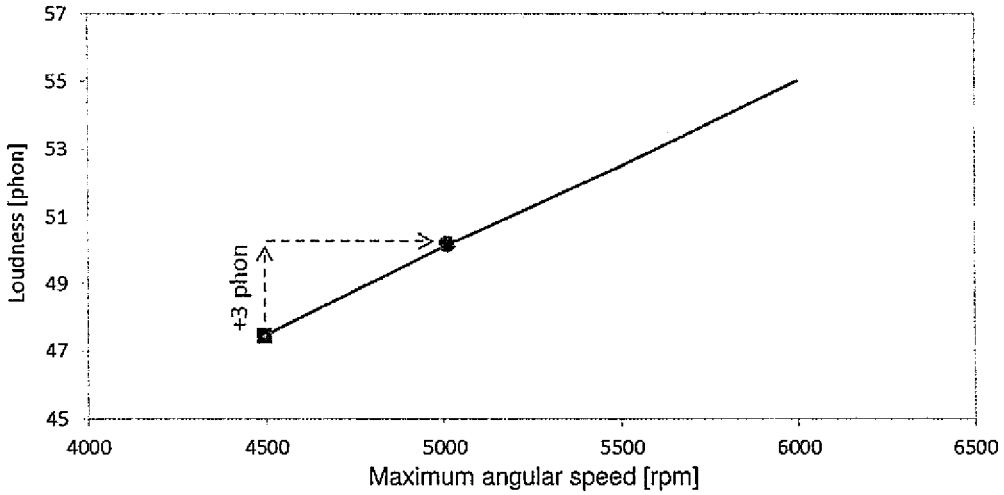
FIG. 4 illustrates a graph of the loudness level as a function of the maximum angular velocity of operation of the compressor. The increase of the maximum angular velocity from 4500 rpm to 5000 rpm leads to an increase of approximately 3 phon.

However, the increase in the angular speed of the electric motor of the compressor generates a penalty in the noise of the compressor, because the noise generation increases and, coincidentally, the perception of the noise also increases due to the dimensional characteristics of the housing. As can be seen in the graph of loudness as a function of the angular velocity of the compressor (FIG. 4), the noise perception increases by at least 3 phon, when the maximum angular velocity of the compressor is increased from 4500 rpm to 5000 rpm.

In this context, it is worth emphasizing that the operational speed of the electric motor (greater than the conventional maximum speed of 4500 rpm, in accordance with the current state of the art) does not generate relevant penalties with respect to the amplification of operation noises, after all, the vibrations generated by the compressor in operation will be amplified by the housing in its natural frequencies that are now above 4200 Hz, from which the sensitivity of the human ear begins to decrease.

In addition, if we make a simple arithmetic sum of the effects of the proposed solution, we will have a reduction of 6 phon (effect of the increase of housing natural frequencies and the reduction of housing area) against an increase of 3 phon (generated by the increase of the angular velocity), generating a net reduction of 3 phon in the perceived noise.

The maximum refrigeration capacity generated by a compressor can be equated in the following manner: "$cap=\eta_{vol}\times\rho\times V_{swept}\times f\times\Delta H$", being that "$\eta_{vol}$" is the volumetric yield of said compressor, "$\rho$" is the density of the refrigerant fluid in the suction pressure, "$V_{swept}$" is the displaced volume of the compression cylinder, "f" is the angular speed of operation of the compressor motor and "$\Delta H$" is the difference of evaporation enthalpy of the refrigeration system.

In accordance with the invention in question, whose premise considers a compression volume compression mechanism of less than 8 $cm^3$ driven by an electric motor, whose maximum angular velocity is of 5000 rpm, operating under the normative condition Ashrae LBP (−23.3° C. of evaporating temperature and 54.4° C. of condensing temperature), the hermetic compressor for positive displacement disclosed herein is especially adapted to generate a refrigeration capacity of approximately 223 W.

One way to measure the capacitance density of a compressor is given by the following formula: "capacitance density=Cap/Vol_int", being that "cap" is the refrigeration capacity in Ashrae LBP and "Vol_int" is the internal volume of the housing of the compressor in liters (without internal components). In this regard, considering the hermetic compressor for positive displacement object of the invention in question, whose internal functional volume is of 1.4 liters, the "capacitance density" is of 160 W/L.

Figure 1:
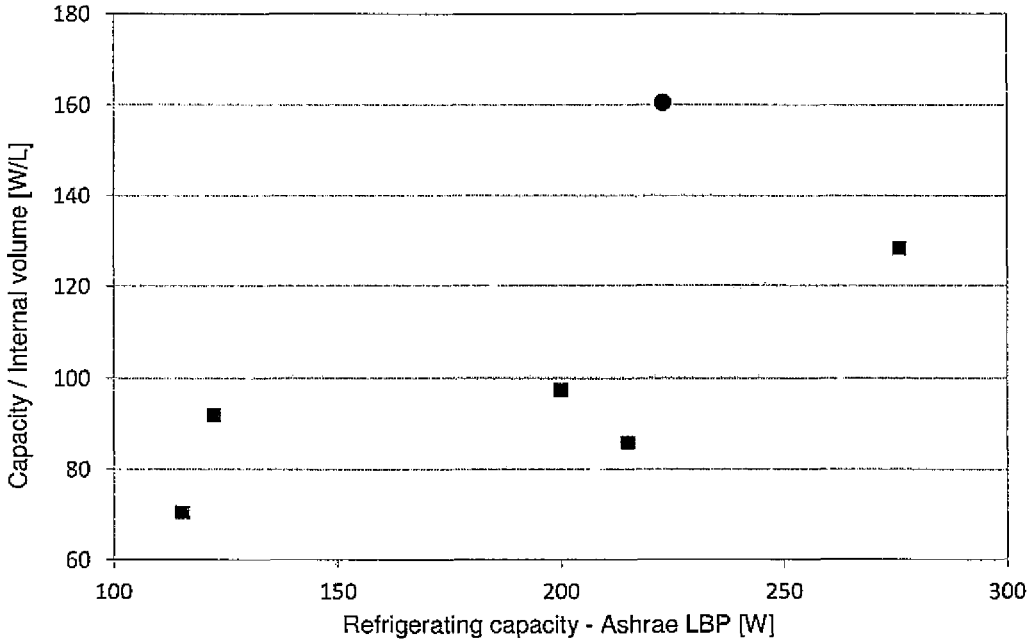
FIG. 1 illustrates a comparative graph between the "capacitance density" of the hermetic compressor for positive displacement disclosed herein (circular marking) and other compressors belonging to the current state of the art (square markings)

FIG. 1, which refers to a graph of "capacitance density", considering the Ashrae LBP normative condition, illustrates, in a comparative manner, traditional compressors belonging to the current state of the art (square markings) and the hermetic compressor for positive displacement (circular marking). In this sense, it is possible to observe that the proposed solution presents a "capacitance density" significantly superior in view of the existing compressors.

It is important to note that the above description has the sole objective of describing in an exemplary manner the particular embodiment of the invention in question. Therefore, it is clear that modifications, variations and constructive combinations of the elements that perform the same function, in substantially the same manner, to achieve the same results, remain within the scope of protection delimited by the appended claims.

The invention claimed is:

1. A hermetic compressor for positive displacement, the compressor comprising:

at least one airtight housing defined by the joining of at least one body and at least one cap;

at least one compression mechanism defined by at least one compression cylinder and a movable piston;

at least one electric motor controlled by at least one electronic control system;

said at least one compression mechanism and said at least one electric motor being associated with each other;

said at least one compression mechanism and said at least one electric motor being housed within said airtight housing;

said compressor for positive displacement comprising an internal functional volume 0.88 liters to 1.4 liters and the at least one compression cylinder with a compression volume of 5 $cm^3$ to 8 $cm^3$;

wherein the compressor is sized such that said at least one airtight housing has a reduced surface area;

wherein said at least one airtight housing comprises a first natural frequency of vibration greater than 4200 Hz;

wherein a capacity density of the compressor is from 160 W/L to 308 W/L when said compressor operates in an ASHRAE low back pressure (LBP) condition, and wherein the ASHRAE LBP condition is defined as an evaporating temperature of −23.3° C. and a condensing temperature of 54.4° C.

2. The compressor according to claim 1, wherein said at least one electric motor has a maximum angular velocity of 5000 rpm to 6000 rpm.

3. The compressor according to claim 1, wherein the compressor generates a refrigeration capacity of 200 W to 270 W.

4. The compressor of claim 1, wherein the compressor is a reciprocating hermetic compressor.

* * * * *